US011524201B2

(12) United States Patent
Gore

(10) Patent No.: US 11,524,201 B2
(45) Date of Patent: Dec. 13, 2022

(54) EXERCISE MACHINE

(71) Applicant: Recreation Supply, Inc., Lewis Center, OH (US)

(72) Inventor: Alan Gore, Lewis Center, OH (US)

(73) Assignee: Recreation Supply, Inc., Lewis Center, OH (US)

( * ) Notice: Subject to any disclaimer, the term of this patent is extended or adjusted under 35 U.S.C. 154(b) by 236 days.

(21) Appl. No.: 16/904,938

(22) Filed: Jun. 18, 2020

(65) Prior Publication Data

US 2020/0316426 A1 Oct. 8, 2020

Related U.S. Application Data

(63) Continuation of application No. 16/038,586, filed on Jul. 18, 2018, now Pat. No. 10,695,602.

(51) Int. Cl.

| | |
|---|---|
| ***A63B 21/00*** | (2006.01) |
| ***A63B 23/12*** | (2006.01) |
| ***A63B 21/002*** | (2006.01) |

(52) U.S. Cl.

CPC ..... *A63B 21/154* (2013.01); *A63B 21/00065* (2013.01); *A63B 21/002* (2013.01); *A63B 21/152* (2013.01); *A63B 23/12* (2013.01)

(58) Field of Classification Search

CPC ..... A63B 21/00058; A63B 21/00061; A63B 21/00065; A63B 21/00069; A63B 21/00072; A63B 21/00076; A63B 21/00178; A63B 21/00181; A63B 21/002; A63B 21/0023; A63B 21/062; A63B 21/0622; A63B 21/0624; A63B 21/0626; A63B 21/0628; A63B 21/063;

(Continued)

(56) References Cited

U.S. PATENT DOCUMENTS

| | | | |
|---|---|---|---|
| 4,402,504 | A | 9/1983 | Christian |
| 4,795,149 | A | 1/1989 | Pearson |

(Continued)

FOREIGN PATENT DOCUMENTS

| | | | |
|---|---|---|---|
| CN | 2488548 | Y | 5/2002 |
| CN | 202289333 | U | 7/2012 |

(Continued)

OTHER PUBLICATIONS

Bodycraft, XPRESS Strength Training System Instruction Manual, Mar. 31, 2003, 13 page, Sunbury, Ohio USA.

(Continued)

*Primary Examiner* — Gary D Urbiel Goldner

(74) *Attorney, Agent, or Firm* — Standley Law Group LLP; Jeffrey Standley; Adam Smith

(57) ABSTRACT

An exercise machine includes a resistance device and vertical members extending from a base. A moveable section mounted to the vertical members moves vertically along the vertical members and horizontally towards or away from a user. Additional vertical members, which are located outside the vertical members, extend from the base, and accommodate functional training devices which facilitate three-dimensional exercise movements by the user. Each functional training device includes pulleys which accommodate a cable mechanically linked to the resistance device and extending between the pulleys to a cable termination device.

20 Claims, 18 Drawing Sheets

(58) Field of Classification Search
CPC ... A63B 21/0632; A63B 21/078; A63B 21/15; A63B 21/151; A63B 21/152; A63B 21/154; A63B 21/156; A63B 21/159; A63B 21/16; A63B 21/4027; A63B 21/4029; A63B 21/4033; A63B 21/4035; A63B 21/4041; A63B 21/4045; A63B 21/4047; A63B 21/4049; A63B 23/035; A63B 23/03516; A63B 23/04; A63B 23/0405; A63B 23/0482; A63B 23/0494; A63B 23/12; A63B 23/1209; A63B 23/1218; A63B 23/1227; A63B 23/1236; A63B 23/1245; A63B 23/1281; A63B 2023/0411; A63B 2208/0223; A63B 2208/0285; A63B 2208/029; A63B 2225/09; A63B 2225/093; A63B 2244/09
See application file for complete search history.

(56) References Cited

U.S. PATENT DOCUMENTS

| | | | | |
|---|---|---|---|---|
| 5,184,992 | A * | 2/1993 | Banks | A63B 21/06 482/104 |
| 5,215,510 | A | 6/1993 | Baran | |
| 5,273,506 | A | 12/1993 | Dawson, Jr. | |
| 5,669,859 | A | 9/1997 | Liggett et al. | |
| 5,725,459 | A | 3/1998 | Rexach | |
| 5,738,615 | A | 4/1998 | McCollum et al. | |
| 6,394,935 | B1 | 5/2002 | Lake | |
| 6,623,409 | B1 | 9/2003 | Abelbeck | |
| 7,131,937 | B2 | 11/2006 | Skilken et al. | |
| 7,374,516 | B2 * | 5/2008 | Lundquist | A63B 21/0783 482/106 |
| 7,455,629 | B2 | 11/2008 | Abelbeck | |
| 7,488,277 | B1 | 2/2009 | Knapp | |
| 7,520,843 | B1 | 4/2009 | Goddard | |
| 7,549,950 | B1 | 6/2009 | Lundquist et al. | |
| 7,651,443 | B1 | 1/2010 | Fenster et al. | |
| 7,666,124 | B2 | 2/2010 | Vaes | |
| 7,815,555 | B2 * | 10/2010 | Webber | A63B 21/0783 482/106 |
| 7,837,600 | B1 | 11/2010 | Habing | |
| 7,998,038 | B2 * | 8/2011 | Keiser | A63B 21/00069 482/112 |
| 8,047,972 | B1 | 11/2011 | Dean et al. | |
| 8,231,509 | B2 | 7/2012 | Lundquist | |
| 8,323,158 | B2 * | 12/2012 | Keiser | A63B 21/00065 482/137 |
| 8,328,698 | B1 * | 12/2012 | Webber | A63B 21/4043 482/106 |
| 8,870,718 | B2 | 10/2014 | Habing | |
| 9,050,496 | B2 | 6/2015 | Towley, III et al. | |
| 9,067,100 | B2 | 6/2015 | Habing | |
| 9,067,102 | B2 * | 6/2015 | Poppinga | A63B 21/0783 |
| 9,302,139 | B2 | 4/2016 | Habing et al. | |
| 9,314,659 | B2 | 4/2016 | Gvoich | |
| 10,556,144 | B2 | 2/2020 | Habing et al. | |
| 10,695,602 | B2 * | 6/2020 | Gore | A63B 21/154 |
| 2002/0091043 | A1 | 6/2002 | Rexach | |
| 2007/0037674 | A1 | 2/2007 | Finn et al. | |
| 2007/0042876 | A1 | 2/2007 | Lundquist | |
| 2007/0203002 | A1 * | 8/2007 | Webber | A63B 21/078 482/142 |
| 2008/0051264 | A1 * | 2/2008 | Webber | A63B 21/078 482/98 |
| 2008/0220951 | A1 | 9/2008 | Webber | |
| 2009/0124469 | A1 * | 5/2009 | Webber | A63B 21/0618 482/98 |
| 2012/0065035 | A1 | 3/2012 | Makula | |
| 2013/0184128 | A1 | 7/2013 | Towley, III et al. | |
| 2013/0274075 | A1 * | 10/2013 | Habing | A63B 23/03541 482/102 |
| 2017/0007876 | A1 * | 1/2017 | Lu | A63B 21/0626 |
| 2018/0318635 | A1 * | 11/2018 | Lee | A63B 21/156 |
| 2019/0134452 | A1 * | 5/2019 | Schween | A63B 21/0724 |
| 2020/0023227 | A1 * | 1/2020 | Gore | A63B 21/156 |

FOREIGN PATENT DOCUMENTS

| | | | |
|---|---|---|---|
| CN | 202777697 | U | 3/2013 |
| WO | 2012012578 | A2 | 1/2012 |
| WO | 2013009749 | A1 | 1/2013 |

OTHER PUBLICATIONS

Bodycraft, XPRESS, Sep. 9, 2020, pp. 1-2, USA https://web.archive.org/web/20040205104236/https://www.bodycraft.com, Feb. 5, 2004.
Bodycraft, Elite Strength Training System, Jul. 30, 2020, pp. 1-3, Sunbury, Ohio USA.
Bodycraft, XPRESS Strength Training System Instruction Manual, Mar. 31, 2003, 1 page, Sunbury, Ohio USA.
Bodycraft, XPRESS Brochure, Jul. 19, 2004, 1 page, Sunbury, Ohio USA.
Bodycraft, XPRESS, Sep. 9, 2020, pp. 1-2, USA https://web.archive.org/web/20040205104236/https://www.bodycraft.com.
Bodycraft, XPRESS Strength Training System Instruction Manual, Sep. 11, 2020, pp. 1-13, Sunbury, Ohio USA.
FT2, Inspire Assembly & Operation Manual, Nov. 2012, pp. 1-33, Anaheim, CA USA.
Bodycraft, XPRESS Pro, Sep. 11, 2020, pp. 1-2, Sunbury, OhioUSA.

* cited by examiner

EXERCISE MACHINE

CROSS-REFERENCE TO RELATED APPLICATION

This application is a continuation of U.S. application Ser. No. 16/038,586 filed Jul. 18, 2018, the disclosures of which are hereby incorporated by reference as if fully restated herein.

TECHNICAL FIELD

Exemplary embodiments of the present invention relate generally to exercise machines.

BACKGROUND AND SUMMARY OF THE INVENTION

The use of free weights to perform exercises is well known. Generally speaking, free weight exercises involve the repeated movement of a weight through a given motion. The health benefits of weight lifting are well known. In recent years, some free weight exercises have been replaced by the use of exercise machines. These machines generally attempt to emulate the motion of various free weight exercises. These machines can sometimes be used to emulate multiple weight lifting exercises using a single, compact machine. Such machines can also offer greater safety benefits such as preventing improper movements and dropped weights.

One such known exercise machine is described in U.S. Pat. No. 7,666,124 B2, dated Feb. 23, 2010 (the "'124 patent"). Briefly summarized, the '124 patent provides an exercise machine comprising a moveable section connected to a frame such that the moveable section may be moved vertically along the frame and horizontally towards and away from the frame. In this way, the '124 patent may better emulate the natural movement of some free weight exercises, such as but not limited to, a bicep curl.

In recent years, functional weight lifting exercises have also increased in popularity. These exercises are intended to better emulate real world, practical uses of the muscles by engaging multiple muscle groups when performing an exercise instead of isolating a particular muscle group. One might compare a bicep curl, which is intended to engage the bicep, with a chin-up, which engages the biceps, shoulders, and back muscles, among others. There is a desire to incorporate additional exercises, such as but not limited to functional exercises, with known exercise machines. However, such functional exercises generally require freedom of movement in multiple directions, which is not provided by many exercise machines. Even a traditionally isolating exercise, such as the bicep circle, when performed with free weights engages more functional muscles like those secondary muscles used to steady the weight. Traditional weight machines limit freedom of movement so as to not engage these secondary muscles. Therefore, what is needed is an exercise machine that emulates natural movements and increases freedom of movement for certain exercises in a compact machine.

What is provided is an exercise machine that emulates natural movements and increases freedom of movement for certain exercises in a compact machine. A frame may comprise a base section. A first and second vertical member may be attached to the base section and spaced apart from one another. A horizontal member may extend between the first and second vertical members. A moveable section may be mounted to the first and second vertical members and be configured for vertical movement along the same. The moveable section may likewise be configured for horizontal movement towards or away from the first and second vertical members. The moveable section may be connected to a resistance device to provide resistance.

The moveable section may be connected to the resistance device by way of a series of pulleys and cables. The pulleys and cables may be arranged and configured to provide two-way resistance (i.e., vertically upwards and vertically downwards) on the moveable section. The pulleys may be arranged in an alternating, horizontal stack arrangement so as to maintain tension on the moveable section.

A third and fourth vertical member may be attached to the base section and spaced apart from one another. The third and fourth vertical members may be placed closer to the user than the first and second vertical member though such is not required. A first and second functional device may be attached to each of the third and fourth vertical members, respectively. In exemplary embodiments, the first and second functional device may be a cable pulley device. The first and second functional device may also be connected to a resistance device to provide resistance.

The moveable section may comprise a first and second attachment point. The cable from the first and second functional device may be selectively attached to the first and second attachment point to increase the resistance on the moveable section.

A bracket may be attached to the base section. The bracket may be configured to mate with additional equipment, such as but not limited to, a bench.

An exercise bar may extend between the third and fourth vertical members. The exercise bar may be a chin up bar, dip bar, pull up bar, or the like.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Similar features may be numbered similarly herein but with the addition of an alphanumerical designation (e.g., 70*a*, 70*b*, 70*c*, etc.). The base callout number may be used to refer to one or more of the alphanumerically designated items (e.g., item 70 may refer to one or more of 70*a*, 70*b*, 70*c*, etc.).

Figure 1A:
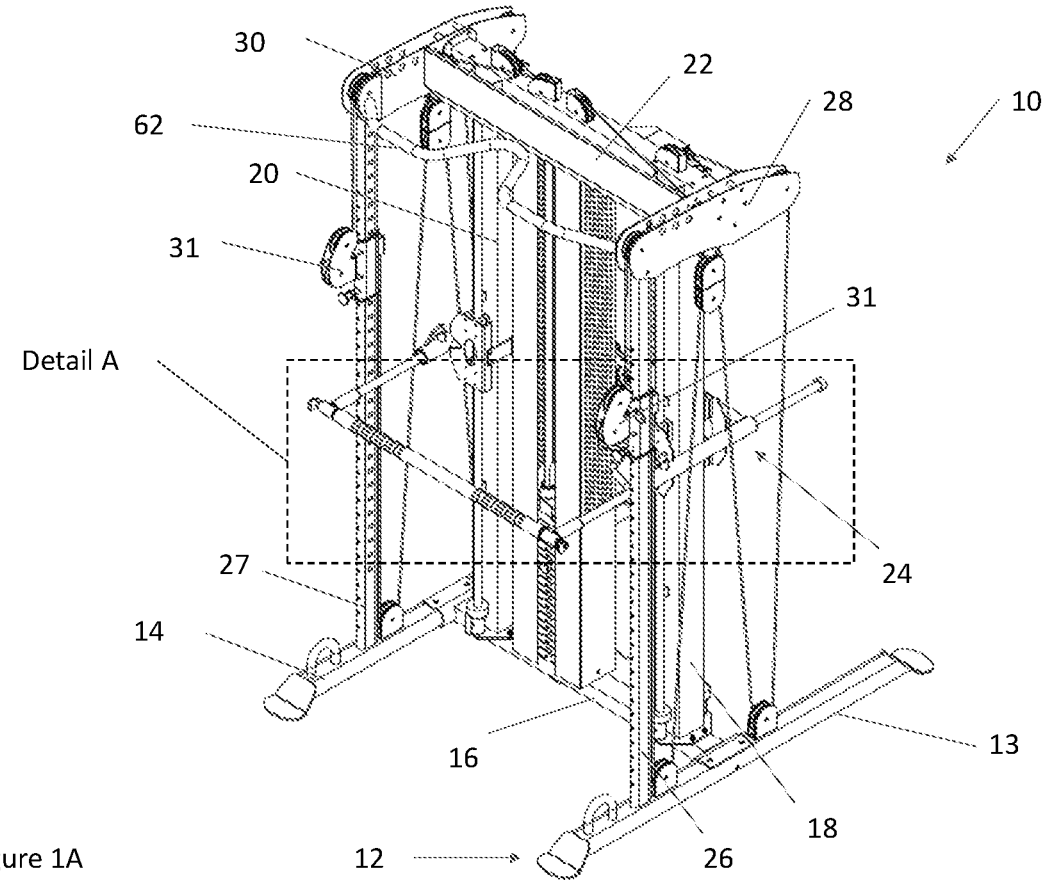
FIG. 1A is a front perspective view of an exemplary exercise machine in accordance with the present invention also indicating Detail A.

FIG. 1A is a front perspective view of an exemplary exercise machine 10 in accordance with the present invention also indicating Detail A. The exercise machine 10 may have a front side which faces an intended user and a rear side which faces away from an intended user. The exercise machine 10 may comprise a base section 12. The base section 12 may comprise a first base member 13 and a second base member 14. The first and second base members 13 and 14 may be spaced apart and located substantially parallel to one another. Alternatively, the first and second base member 13 and 14 may be located at an angle. For example, without limitation, this arrangement may facilitate placement of the exercise machine 10 in a corner. A third base member 16 may extend between the first base member 13 and the second base member 14. The first, second, and third base members 13, 14, and 16 may form a substantially "H" shape. In other exemplary embodiments, the first and second base member 13 and 14 may be located at an angle to form a substantially "V" shape. In such embodiments, the third base member 16 may extend between the first and second base members 13 and 14 to form a substantially "A" or triangular shape.

A first and second vertical member 18 and 20 may extend vertically from the base section 12. In exemplary embodiments, the first and second vertical members 18 and 20 may extend from the third base member 16, though such is not required. The first and second vertical members 18 and 20 may be spaced apart from one another and extend substantially parallel to one another. An upper member 22 may extend between the first and second vertical members 18 and 20.

Figure 1B:
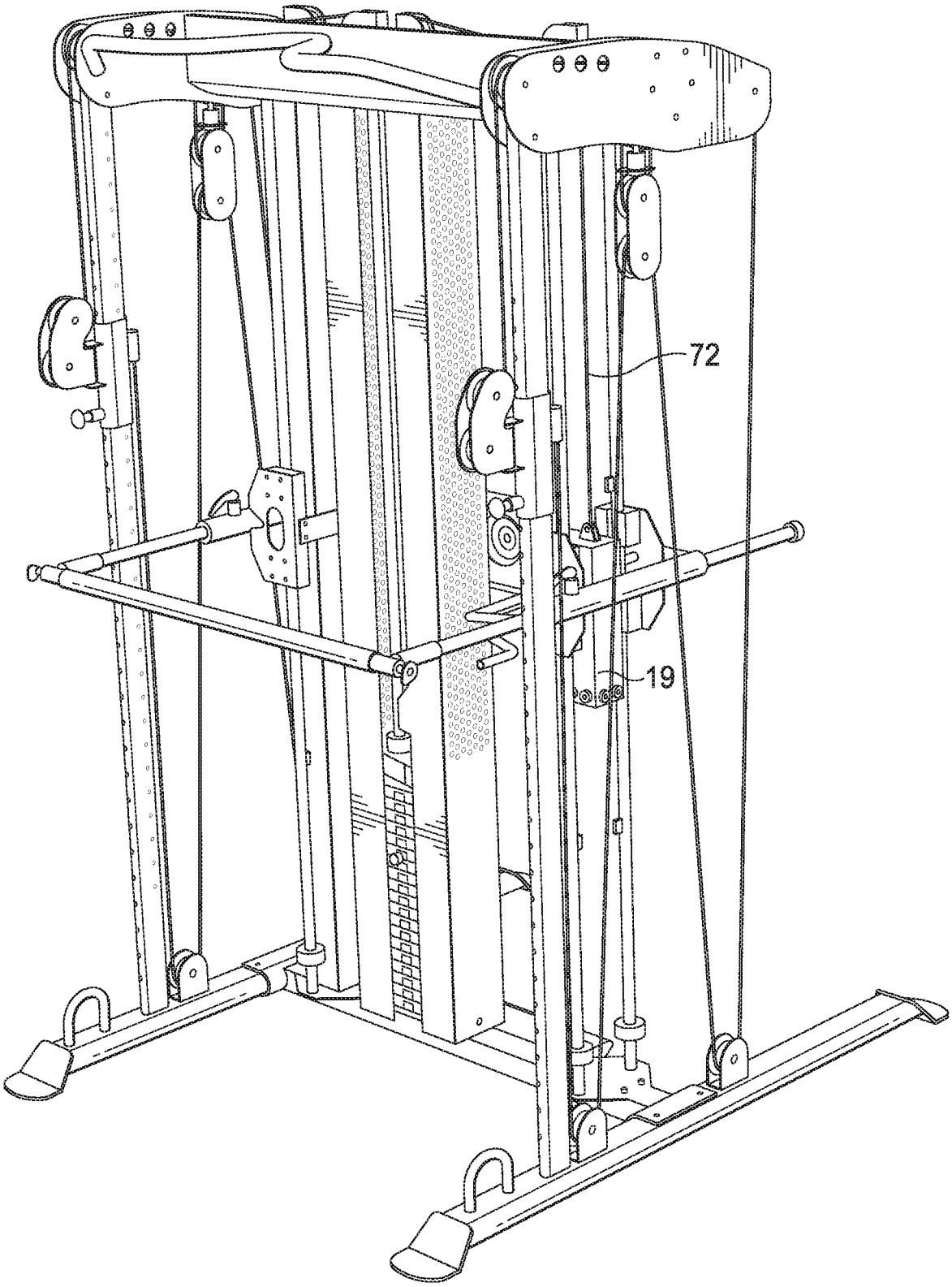
FIG. 1B is a front perspective view of the exercise machine of FIG. 1 with one of the vertical members not illustrated so as to reveal additional components.
Figure 1C:
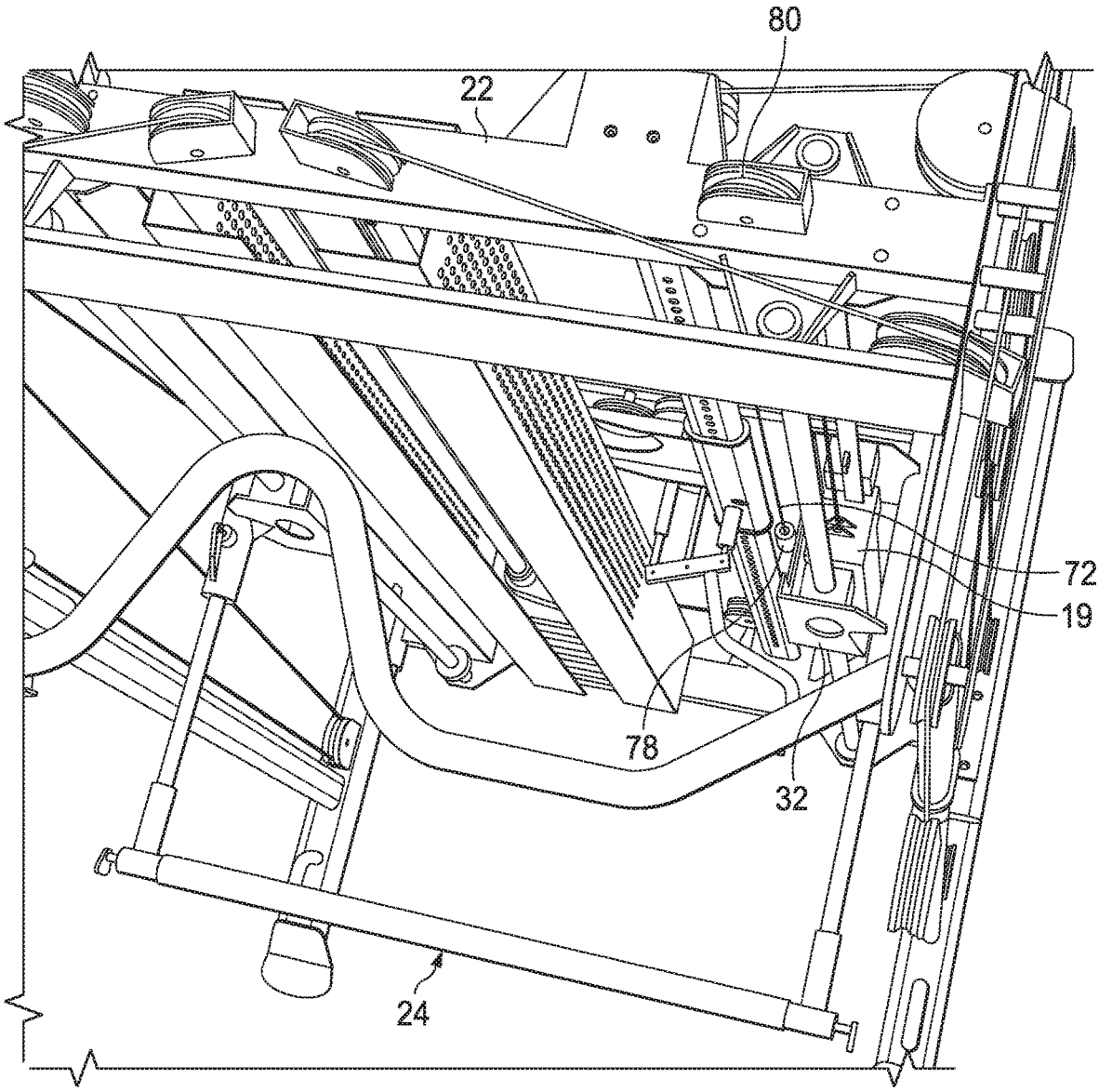
FIG. 1C is a detailed top perspective view of the exercise machine of FIG. 1 with one of the vertical members not illustrated so as to reveal additional components.

FIG. 1B is a front perspective view of the exercise machine 10 with the first vertical member 18 not illustrated so as to reveal a counterweight 19 which is located within the first vertical member 18. FIG. 1C is a top perspective view of the exercise machine 10 with the first vertical member 18 not illustrated so as to reveal how the counterweight 19 is connected to the moveable section 24. The counterweight 19 may be attached to the moveable section 24 by way of a first cable 72. In exemplary embodiments, the first cable 72 may extend vertically from the counterweight 19, through one or more counterweight pulleys 80 to a first sliding device 32. The first sliding device 32 may be mounted, bonded, or otherwise attached to the moveable section 24. Preferably, the counterweight pulley 80 is located on the upper member 22 such that the first cable 72 may extend vertically from the counterweight 19, though the counterweight pulley 80 and then vertically downward to the first sliding device 32. The first cable 72 may terminate at a second cable termination device 78 which may be mounted, bonded, or otherwise attached to a first sliding device 32.

A similar or identical arrangement may be provided with a second counterweight 19 located in the second vertical member 20 and connected to the second sliding device 34.

A moveable section 24 may be mounted to the first and second vertical members 18 and 20. In exemplary embodiments, the movable section 24 may be configured to be moved vertically along the first and second vertical members 18 and 20. The moveable section 24 may be further configured to move horizontally towards or away from an intended user.

A third and fourth vertical member 26 and 27 may extend vertically from the base section 12. In exemplary embodiments, the third vertical member 26 may extend from the first base member 13 and the fourth vertical member 27 may extend from the second base member 14, though such is not required. The third and fourth vertical members 26 and 27 may be spaced apart from one another and extend substantially parallel to one another.

A first and second upper bracket 28 and 30 may be located on either end of the upper member 22. The first and second upper bracket 28 and 30 may extend substantially perpendicular to the upper member 22 such that the upper member 22, the first upper bracket 28, and the second upper bracket 30 form a substantially "H" shape. Stated another way, the first and second upper bracket 28 and 30 may extend in substantially the same direction as the first and second base member 13 and 14, respectively. The first and second upper bracket 28 and 30 may comprise an inner and outer plate which sandwiches a series of pulleys and cables for operating the exercise machine 10. In other exemplary embodiments, the first and second upper brackets 28 and 30 may alternatively or additionally be configured to provide structural support and rigidity to the exercise machine 10. Pulleys located between the first and second upper brackets 28 and 30 may not be required. Some or all of the pulleys may instead by located on the upper member 22 and/or another upper frame member.

An exercise bar 62 may extend between the first and second upper bracket 28 and 30. The exercise bar 62 may be a chin up bar, dip bar, pull up bar, or the like. The exercise bar 62 may comprise one or more bends and/or a texturized surface configured to provide various hand grip locations for the user.

The third and fourth vertical member 26 and 27 may extend upwards to the first and second upper bracket 28 and 30, respectively. The third and fourth vertical members 26 and 27 may be configured to accommodate functional training devices 31. In exemplary embodiments, the functional weight training devices 31 are configured to be moved vertically along the third and fourth vertical members 26 and 27 and be selectively secured in various vertical positions. In exemplary embodiments, the functional training devices 31 are cable pull devices which comprise a cable and one or more attachment devices configured to receive one or more attachments. For example, without limitation, the functional training devices 31 may comprise a first and second pulley, a cable extending between said first and second pulleys, and a carabiner located on a distal end of said cable, wherein the carabiner is configured to receive one or more hand grips. This may permit for the integration of the functional training devices 31 with the single, compact exercise machine 10.

Figure 2:
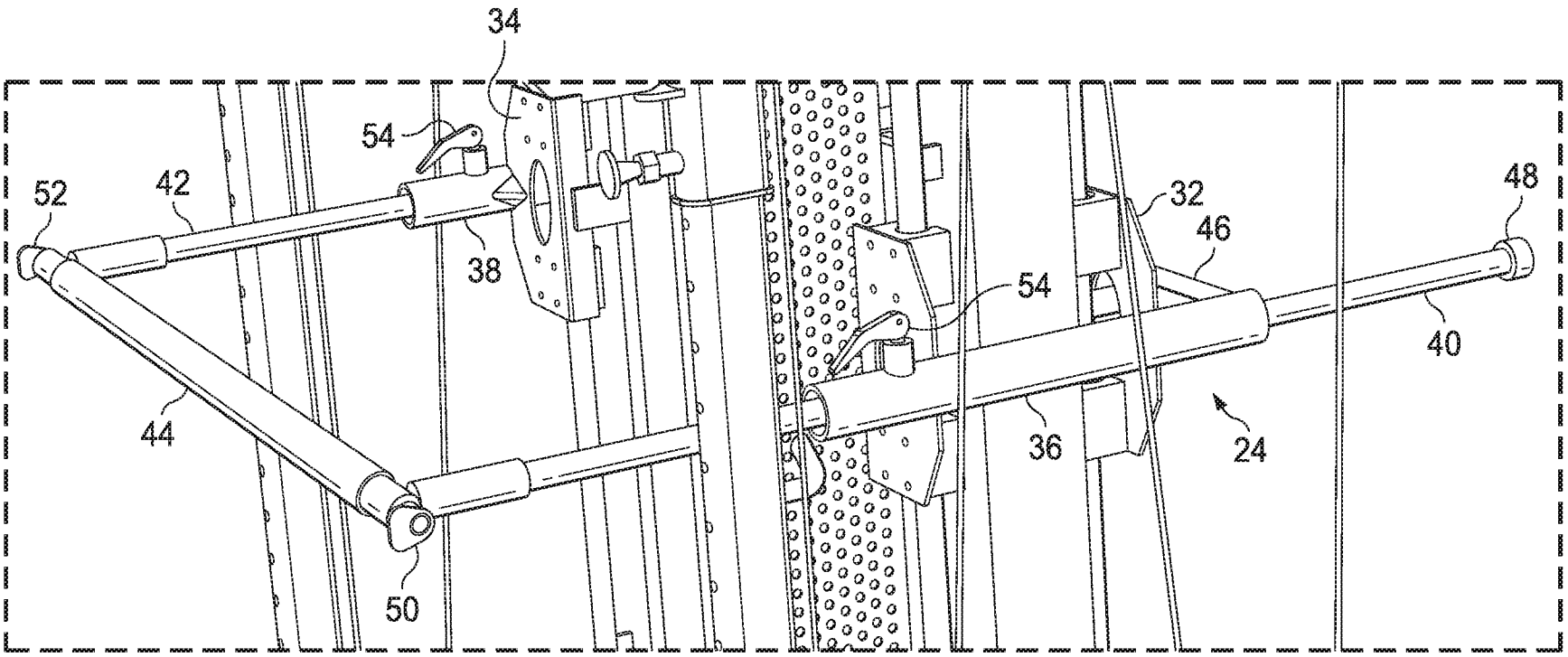
FIG. 2 is a detailed perspective view of Detail A of FIG. 1.

FIG. 2 is a detailed perspective view of Detail A of FIG. 1. The moveable section 24 is illustrated in greater detail. The moveable section 24 may comprise a first and second sliding device 32 and 34. The first and second sliding device 32 and 34 may be mounted to the first and second vertical members 18 and 20, respectively. The first and second sliding device 32 and 34 may be configured to permit vertical movement of the movable section 24 along the first and second vertical members 18 and 20. In exemplary embodiments, the first and second sliding device 32 and 34 may comprise linear bearings to facilitate said vertical movement. In other exemplary embodiments, the first and second sliding device 32 and 34 may comprise wheels, bushings, rollers, or the like.

The moveable section 24 may further comprise a first and second tube 36 and 38 attached to the first and second sliding devices 32 and 34, respectively. The first and second tube 36 and 38 may be configured to receive a first and second horizontal bar 40 and 42, respectively. The first and second tube 36 and 38 may be configured to receive the first and second horizontal bars 40 and 42 in a sliding arrangement such that the first and second horizontal bars 40 and 42 may be moved horizontally towards or away from the center of the exercise machine 10. Stated another way, the first and second tube 36 and 38 may be configured to receive the first and second horizontal bars 40 and 42 in a sliding arrangement such that the first and second horizontal bars 40 and 42 may be moved horizontally towards or away from the intended user of the exercise machine 10. A stopper device 48 may be located on the distal end of each of the first and second horizontal bars 40 and 42. The stopper device 48 may be sized such that it is prevented from entering the first and second tube 36 and 38. In this way, the horizontal movement of the moveable section 24 may be limited. This may also prevent the first and second horizontal bars 40 and 42 from being removed from the first and second tubes 36 and 38.

A front bar 44 may be connected between the first and second horizontal bars 40 and 42 on the front side of the exercise machine 10. In other exemplary embodiments, a first and second handle may be attached to the first and second horizontal bars 40 and 42, respectively. The first and second handles may be used in addition to the front bar 44 or instead of the front bar 44.

The front bar 44 may extend beyond the first and second horizontal bars 40 and 42, though such is not required. The front bar 44 may be configured to accommodate various user grips and may be texturized to facilitate a user gripping the front bar 44. The front bar 44 may also limit horizontal movement of the moveable section 24. A first and second attachment device 50 may be located on either end of the front bar 44. In exemplary embodiments, the first and second attachment devices 50 and 52 may be located on portions of the front bar 44 that extend beyond the first and second horizontal bars 40 and 42. The first and second attachment devices 50 and 52 may be configured to be attached to the functional training devices 31. In this way, the resistance on the moveable section 24 may be increased.

One or more securing devices 54 may be located on the moveable section 24. The securing devices 54 may be configured to selectively secure the horizontal position of the front bar 44. In exemplary embodiments, the securing devices 54 are located on the first and second tubes 36 and 38, respectively. The securing devices 54 may be configured to frictionally engage the first and second horizontal bars 40 and 42.

A rear bar 46 may extend between the first and second tubes 36 and 38 and may be located behind the first and second sliding devices 32 and 34. The rear bar 46 may also limit horizontal movement of the moveable section 24.

Figure 3:
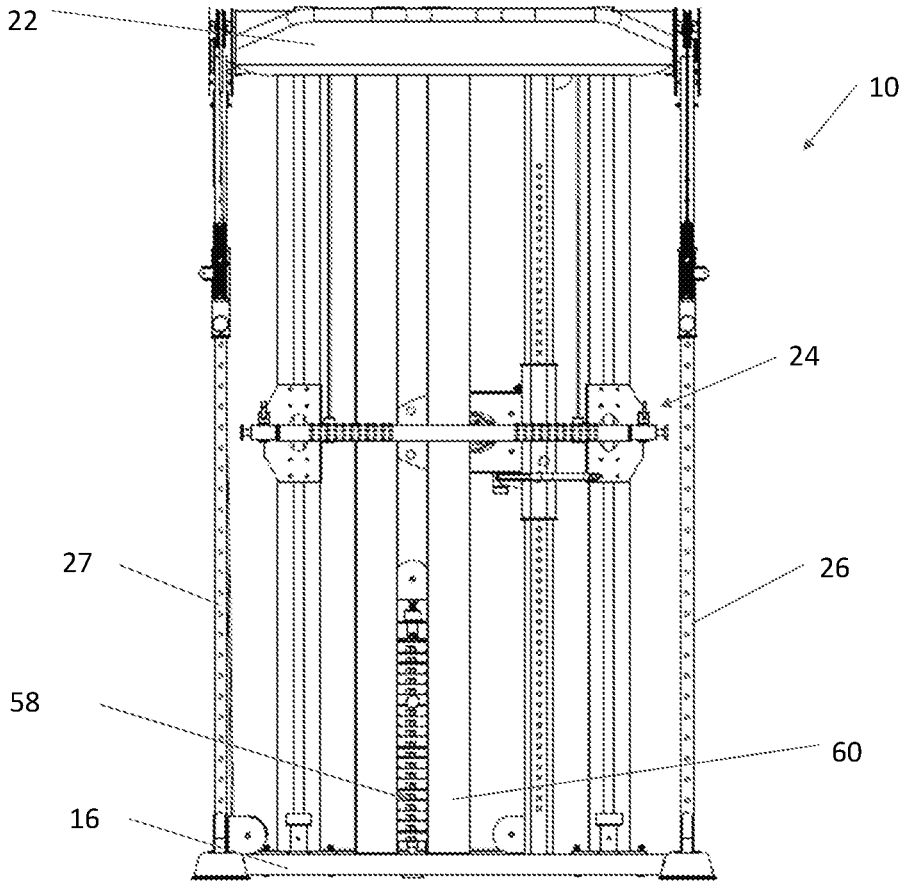
FIG. 3 is a front view of the exercise machine of FIG. 1.

FIG. 3 is a front view of the exercise machine 10 of FIG. 1. A resistance device 58 may be located near the center of the exercise machine 10, although any location is contemplated. The resistance device 58 may be a weight stack, weight plates (such as, without limitation, Olympic, or standard weight plates), an electric motor, a friction imparting mechanism, or the like.

In exemplary embodiments, the resistance device 58 may extend vertically from the third base member 16 towards the upper member 22. In exemplary embodiments, the resistance device 58 may be partially or wholly surrounded by a shroud 60, though such is not required.

Figure 4:
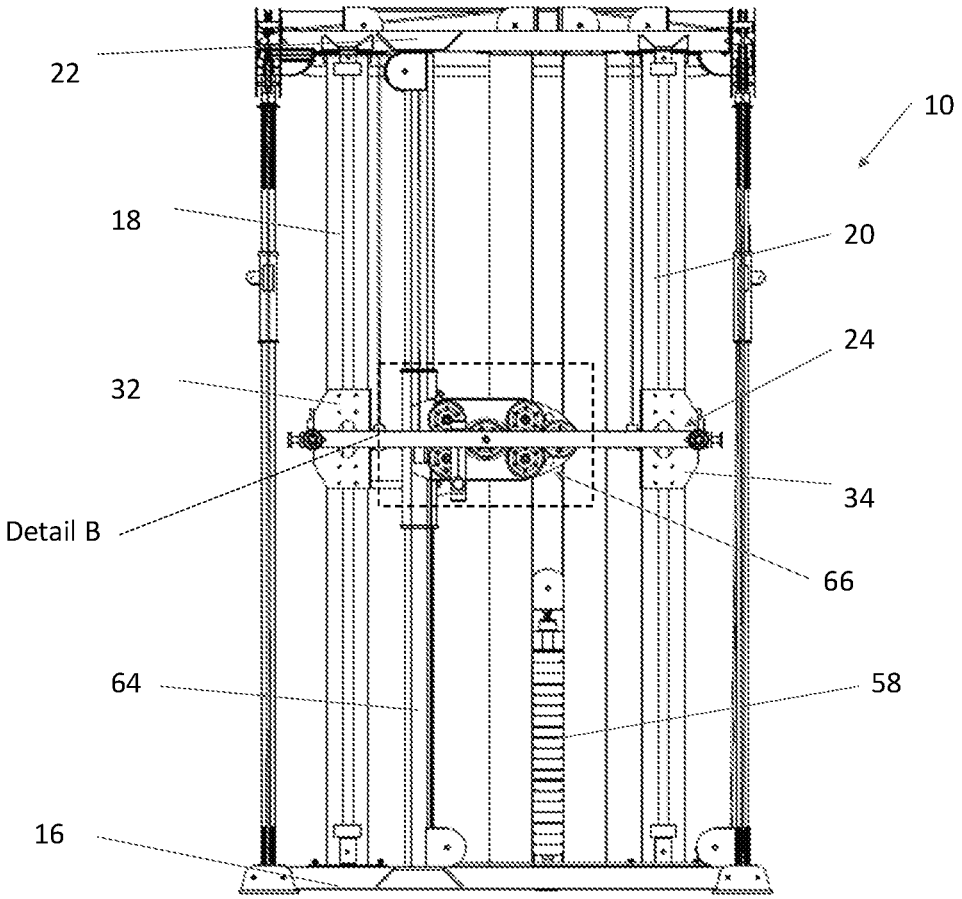
FIG. 4 is a rear view of the exercise machine of FIG. 1, also indicating Detail B.

FIG. 4 is a rear view of the exercise machine 10 of FIG. 1, also indicating Detail B. A cable tensioning device 66 may be located on a fifth vertical member 64. In exemplary embodiments, the cable tensioning device 66 is located on the rear side of the exercise machine 10. The fifth vertical member may extend from the third base member 16 to the upper member 22. The cable tensioning device 66 may be configured for vertical movement along the fifth vertical member 64. The cable tensioning device 66 may be configured to provide two-way resistance to the moveable section 24. The cable tensioning device 66 may be configured to keep tension on a second cable 76, which connects the movable section 24 and/or the functional training devices 31 to the resistance device 58.

For example, without limitation, the cable tensioning device 66 may be configured to provide resistance, by way of the resistance device 58, against upward and downward movement of the moveable section 24. In this way, the moveable section 24 may be set to a low position and raised against a resistance set on the resistance device 58, or likewise may be set to a high position and lowered against a resistance set on the resistance device 58.

As a further example, again without limitation, the cable tensioning device 66 may be configured to provide resistance, by way of the resistance device 58, against upward, downward, horizontal, or otherwise outward movement of the functional training devices 31. In this way, one or more of the functional training devices 31 may be set to a low position and raised against a resistance set on the resistance device 58, or likewise may be set to a middle position and moved outward against a resistance set on the resistance device 58. These are merely exemplary uses of the exercise machine 10 and are not intended to be limiting.

Figure 5A:
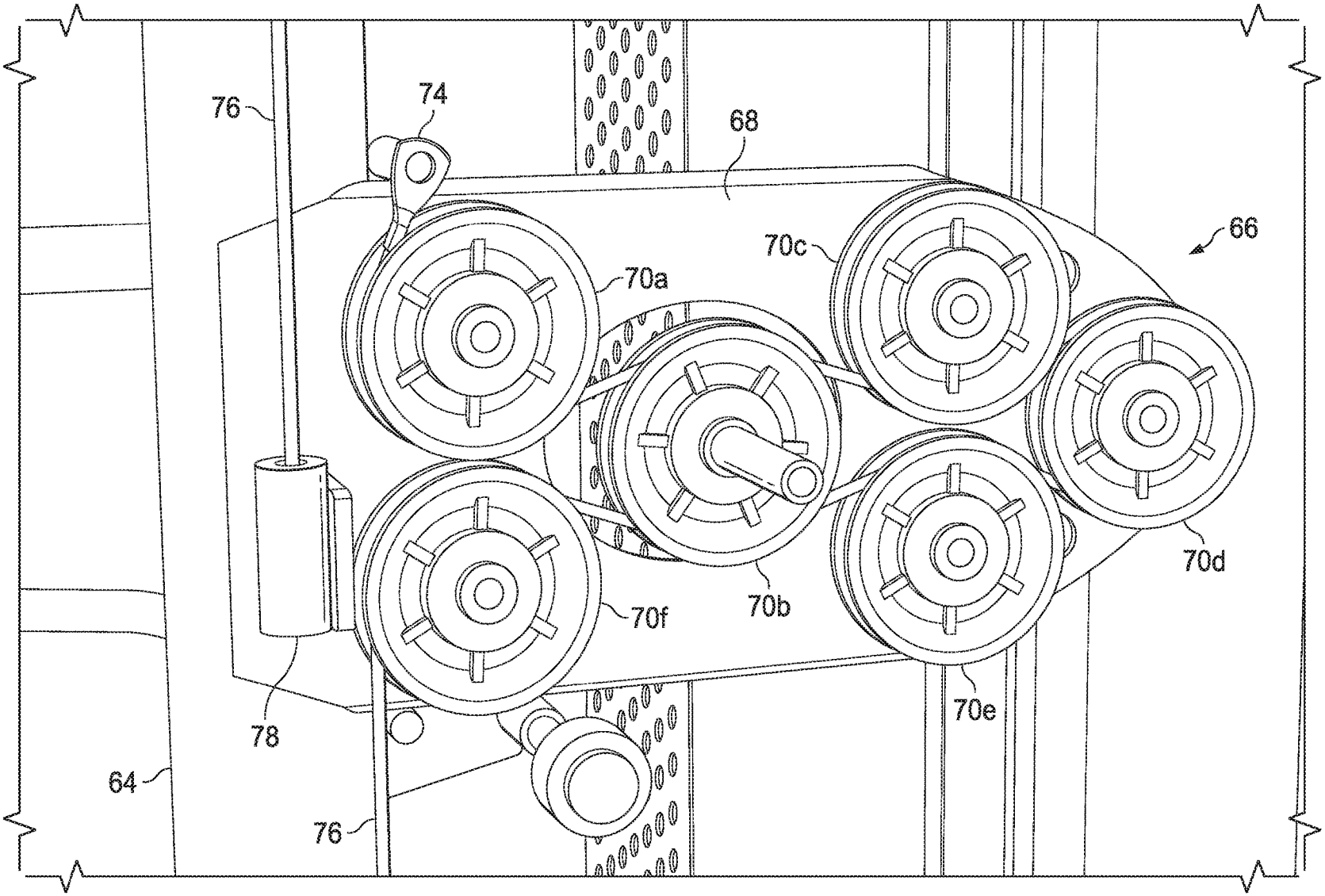
FIG. 5A is a detailed rear view of Detail B of FIG. 4.

FIG. 5A is a detailed rear view of Detail B of FIG. 4. The cable tensioning device 66 may comprise a plate 68 configured to receive one or more pulleys 70. In exemplary embodiments, the pulleys 70 may be arranged in an alternating, horizontal stacked arrangement. For example, without limitation, from left to right the pulleys 70 may be arranged in a 2-1-2-1 arrangement.

The second cable 76, which may be attached to the resistance device 58, may originate at a first cable termination device 74 located on the plate 68. The second cable 76 may extend from the first cable termination device 74 and engage the bottom surface of a first pulley 70*a* located near the upper left side of the plate 68. The second cable 76 may then engage the top surface of a second pulley 70*b* located in the approximate center of the plate 68, the bottom surface of a third pulley 70*c* located near the top right side of the plate 68, the right-side surface of a fourth pulley 70*d* located near the right side of the plate 68, the top surface of a fifth pulley 70*e* located near the lower right corner of the plate 58, the bottom surface of the second pulley 70*b*, and the top surface of a sixth pulley 70*f* located near the lower left corner of the plate 68.

Figure 5B:
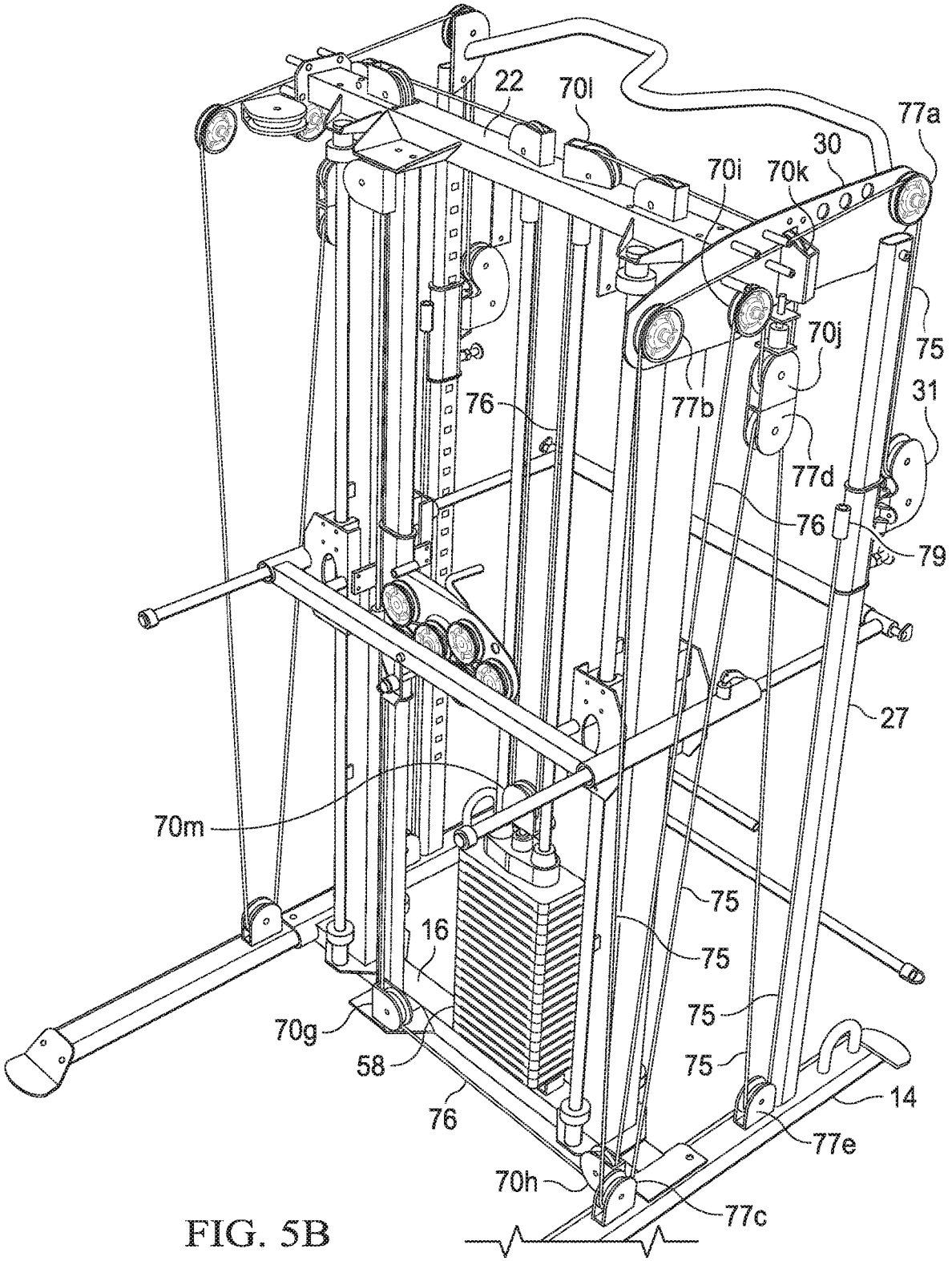
FIG. 5B is a left-side perspective view of the device of FIG. 1 with certain components not illustrated so as to reveal additional components.

FIG. 5B is a left-side perspective view of the device 10 with certain components not illustrated so as to reveal additional components. The second cable 76 may extend from the sixth pulley 70*f* vertically downward. The second cable 76 may then engage a seventh pulley 70*g* and travel horizontally and engage an eighth pulley 70*h*. The second cable 76 may travel vertically upwards and engage a ninth pulley 70*i*. The second cable 76 may then travel vertically downwards until it engages a tenth pulley 80*j* and then travel vertically upwards again until engaging an eleventh pulley 70*k*. The cable then may travel horizontally, in exemplary embodiments along the upper member 22, until engaging a twelfth pulley 70l. The second cable 76 may then travel vertically downwards until engaging a thirtieth pulley 70*m*, which in exemplary embodiments is attached to the resistance device 58.

In exemplary embodiments the seventh pulley 70*g* is located on the third base member 16. The eighth pulley 70*h* may be located on the third base member 16 or the second base member 14. The ninth pulley 70*i* may be located on the second upper bracket 30. The tenth pulley 70*j* may be located on or suspended from the second upper bracket 30. The eleventh pulley 70*k* may be located on the second upper bracket 30 or the upper member 22. The twelfth pulley 70l may be located on the upper member 22, and in exemplary embodiments is directly above the resistance device 58.

A third cable 75 may extend from the functional training device 31 located on the fourth vertical member 27. The third cable 75 may comprise a stopper, such as but not limited to, a ball or carabiner placed on or near the end of the third cable 75 configured to prevent the end of the third cable 75 from traveling beyond the functional training device 31. This stopper may serve as a cable termination device. The third cable 75 may travel vertically upward and engage a first functional device pulley 77*a*. The third cable 75 may then travel horizontally before engaging a second functional device pulley 77*b* and traveling vertically downward to a third functional device pulley 77*c*. The third cable 75 may then travel vertically upwards, in exemplary embodiments at an angle, and engage a fourth functional device pulley 77*d*. In exemplary embodiments, the fourth functional device pulley 77*d* may be attached to the tenth pulley 70*j*. This arrangement may provide a connection between the functional training device 31 to the resistance device 58.

The third cable 75 may then travel vertically downwards, in exemplary embodiments at an angle, and engage a fifth functional device pulley 77*e*. The third cable 75 may then travel vertically upwards and terminate at a third cable termination device 79 located on the functional training device 31. This arrangement may permit the vertical adjustment of the functional training device 31 along the fourth vertical member 27 while maintaining resistance on the third cable 75.

A similar or identical arrangement may be provided with regards to the functional training device 31 located on the third vertical member 26. The equivalent right side fourth functional device pulley 77*f* (similar to the fourth functional device pulley 77*d* located on the opposite side of the device 10) may be connected to the sixteenth pulley 70*o*. This arrangement may provide a connection between the functional training device 31 located on the third vertical member 26 to the resistance device 58. This arrangement may also permit the vertical adjustment of the functional training device 31 along the third vertical member 26 while maintaining resistance on the equitant right side third cable 75*a*.

Figure 5C:
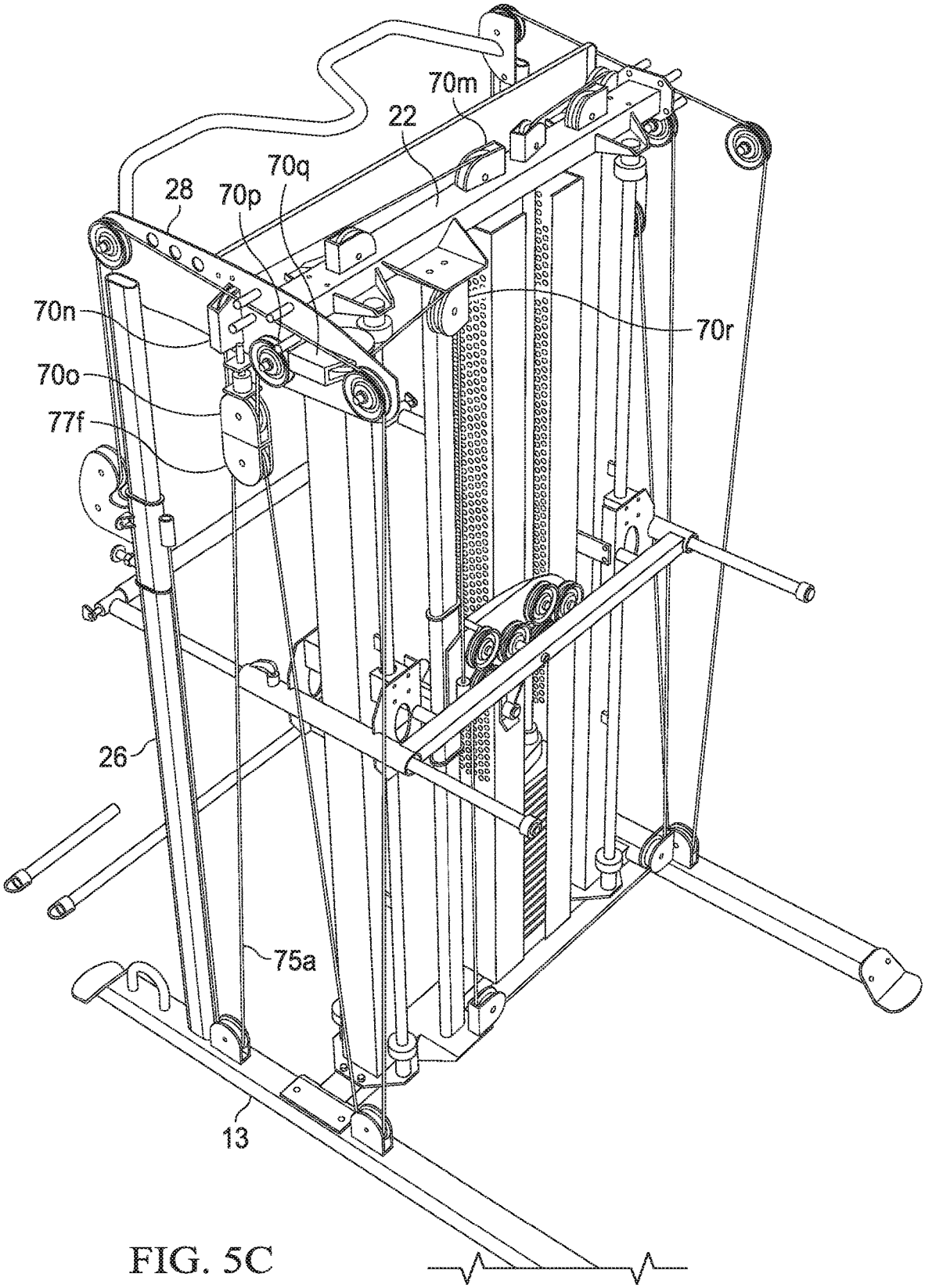
FIG. 5C is a right-side perspective view of the device of FIG. 1 with certain components not illustrated so as to reveal additional components.

FIG. 5C is a right-side perspective view of the device 10 with certain components not illustrated so as to reveal additional components. The second cable 76 may then travel vertically upwards and engage a fourteenth pulley 70*m*. The second cable 76 may then travel horizontally, in exemplary embodiments along the upper member 22, until engaging a fifteenth pulley 70*n*. The second cable 76 may then travel vertically downwards until it engages a sixteenth pulley 70*o* and then travel vertically upwards again until engaging a seventeenth pulley 70*p*. The second cable 76 may then engage an eighteenth pulley 70*q*, which permits the cable to travel horizontally towards center of the device 10 until engaging a ninetieth pulley 70*r*, which permits the second cable 76 to travel vertically downwards until engaging the second cable termination device 78 located on the plate 68.

In exemplary embodiments, the fourteenth pulley 70*m* may be located on the upper member 22. The fifteenth pulley 70*n* may be located on the upper member 22 or the first upper bracket 28. The sixteenth pulley 70*o* may be suspended from the first upper bracket 28. The seventeenth pulley 70*p* and the eighteenth pulley 70*q* may be located on the first upper bracket 28. The nineteenth pulley 70*r* may be mounted, bonded, or otherwise attached to the upper member 22, and in exemplary embodiments is directly above the cable tensioning device 66.

The aforementioned arrangement of the pulleys 70 may keep tension on the cables connecting the resistance device 58 to the moveable section 24 such that two-way resistance (i.e., upward and downward) may be provided and that outwards resistance may be provided to the functional training device 31. However, the number and arrangement of the pulleys 70 is merely exemplary and is not intended to be limiting.

In other exemplary embodiments, the second cable 76 may comprise a first and second part 76*a* and 76*b*. The first part 76*a* and the second part 76*b* may follow the same or a similar configuration as described. However, each may terminate or originate at the resistance device 58. In this way, one-way resistance on the moveable section 24 may be provided. The one-way resistance may be provided in either the vertically upwards or vertically downwards direction. It is contemplated that the second cable 76 may be divided into any number of parts, which may extend from, originate at, or terminate at various points such as, but not limited to, the moveable section 24 and/or the functional training devices 31.

Figure 6:
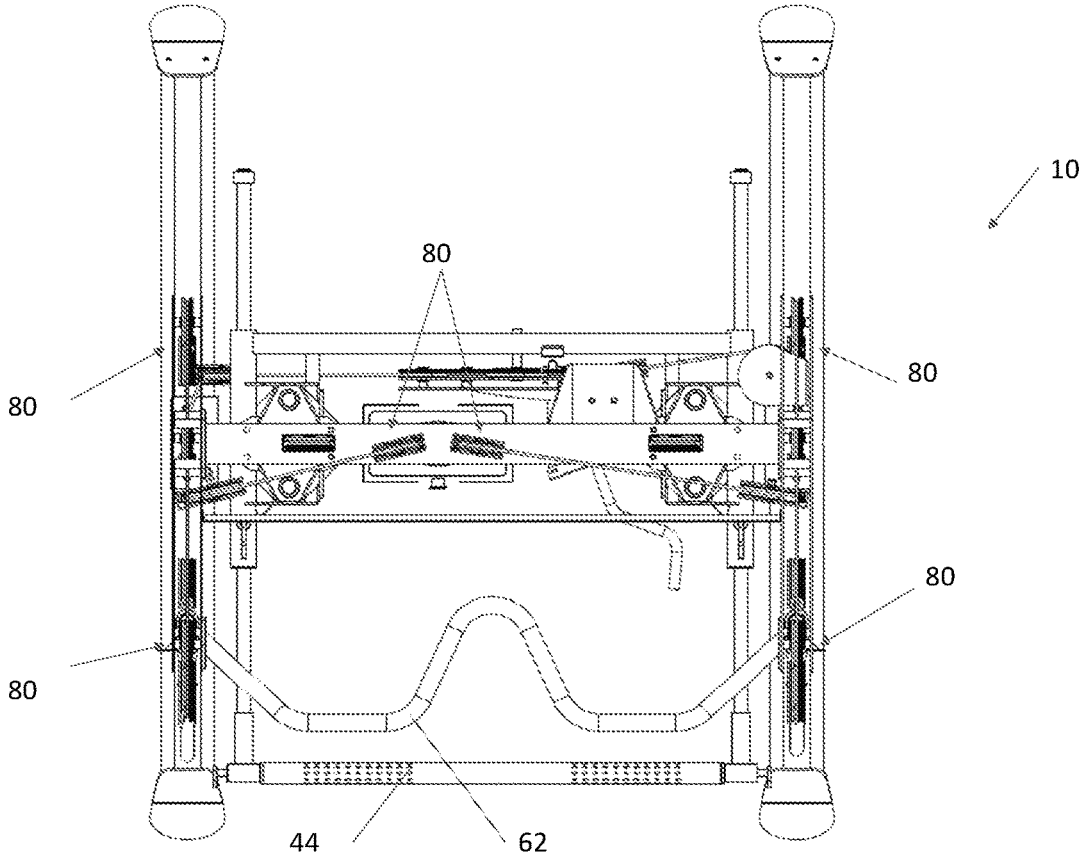
FIG. 6 is a top view of the exercise machine of FIG. 1.
Figure 7:
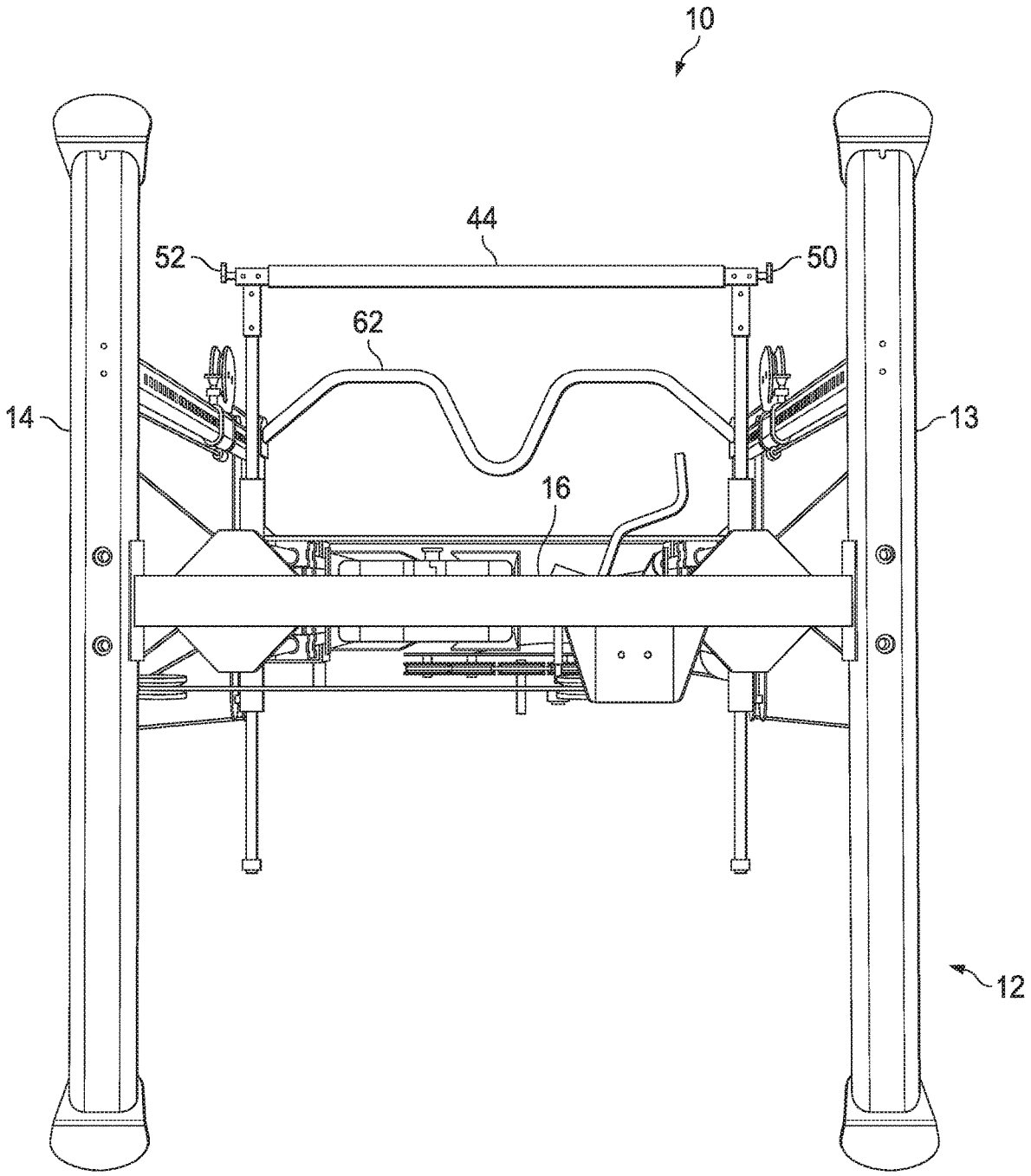
FIG. 7 is a bottom view of the exercise machine of FIG. 1.

FIG. 6 is a top view of the exercise machine 10 of FIG. 1 and FIG. 7 is a bottom view of the exercise machine 10 of FIG. 1. Various additional pulleys may be utilized to connect the resistance device 58 to the moveable section 24 by way of the second cable 76 as well as the functional training devices 31.

Figure 8:
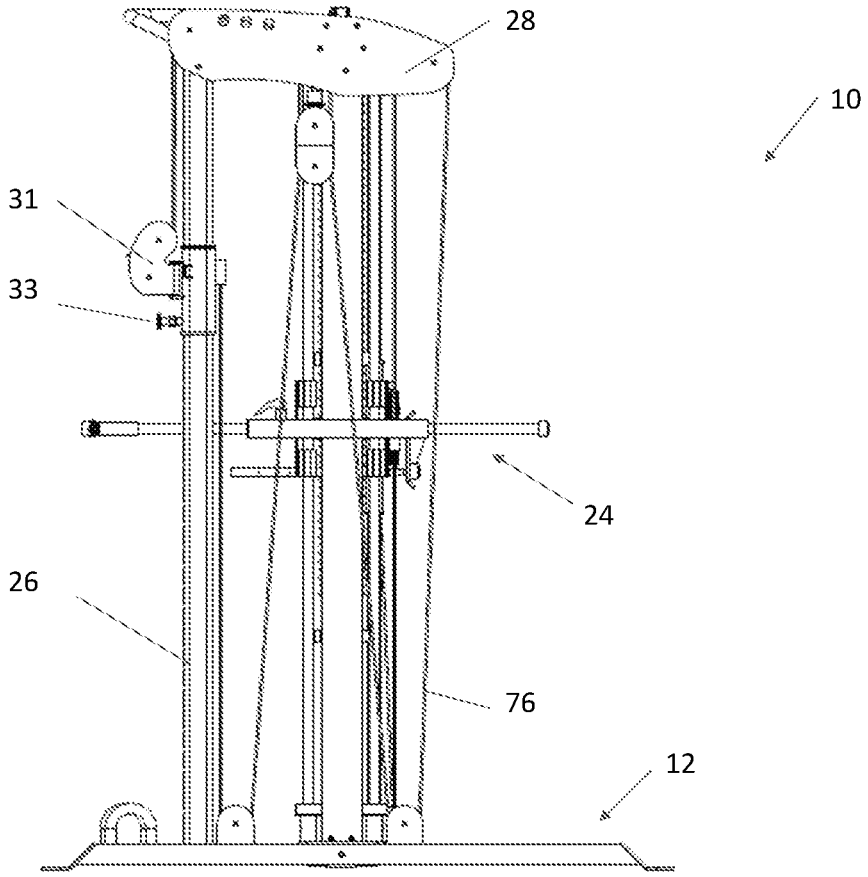
FIG. 8 is a right-side view of the exercise machine of FIG. 1.
Figure 9:
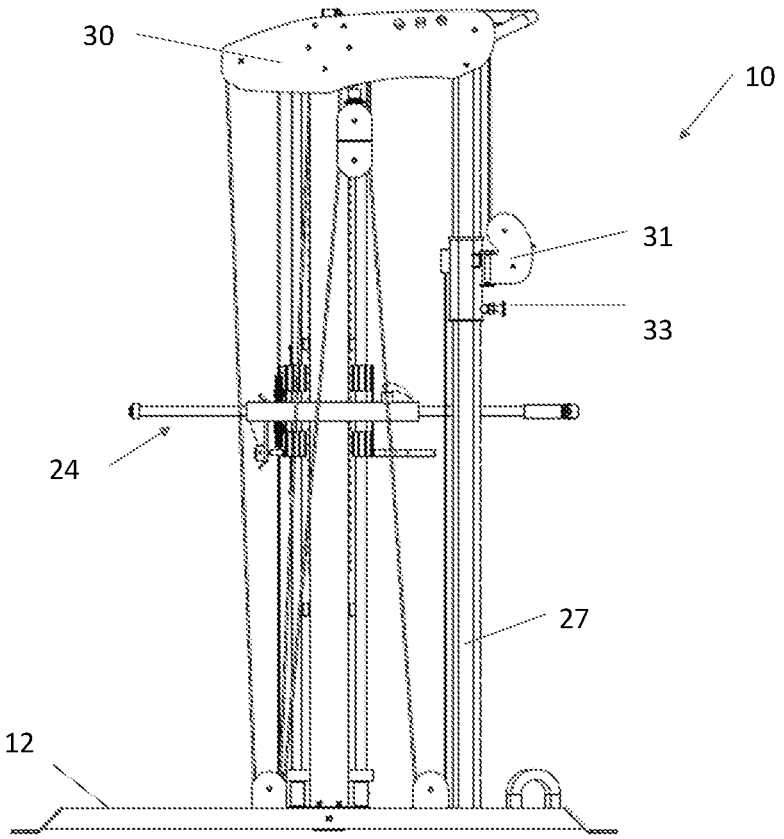
FIG. 9 is a left-side view of the exercise machine of FIG. 1.

FIG. 8 is a right-side view of the exercise machine 10 of FIG. 1 and FIG. 9 is a left-side view of the exercise machine 10 of FIG. 1. The functional training devices 31 may comprise one or more positioning devices 33 configured to selectively secure the functional training devices 31 at locations along the third and fourth vertical members 26 and 27. In exemplary embodiments, the positioning devices 33 may be pins configured to be secured within apertures located on the third and fourth vertical members 26 and 27.

Figure 10A:
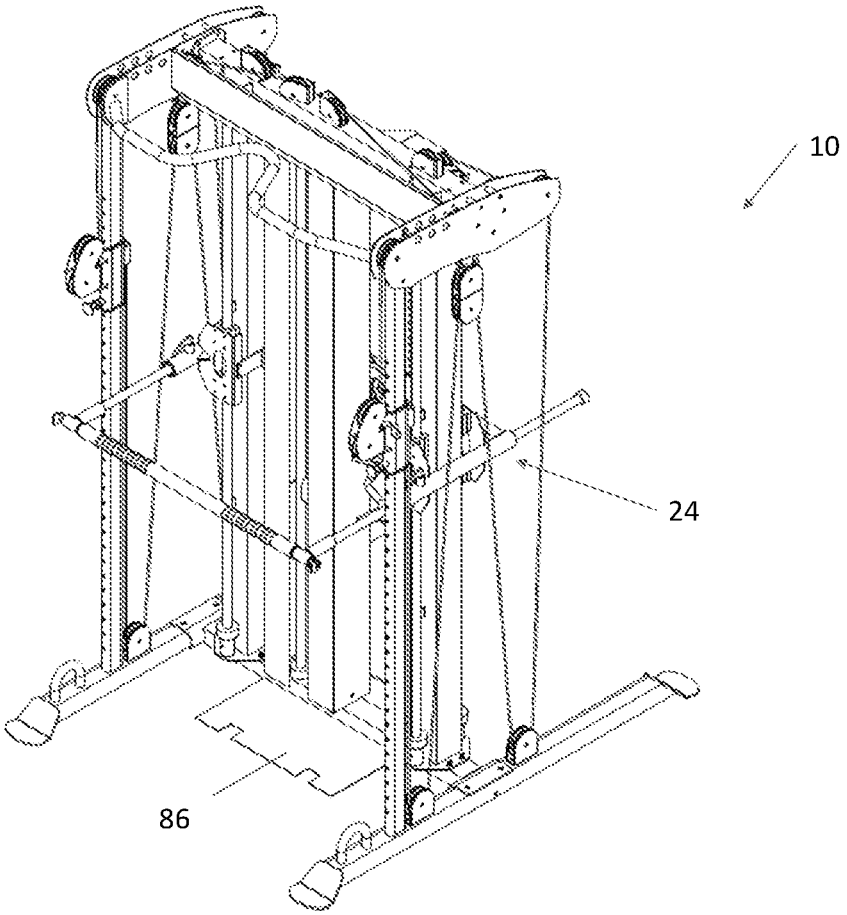
FIG. 10A is a front perspective view of the exercise machine of FIG. 1 with an additional bracket.
Figure 10B:
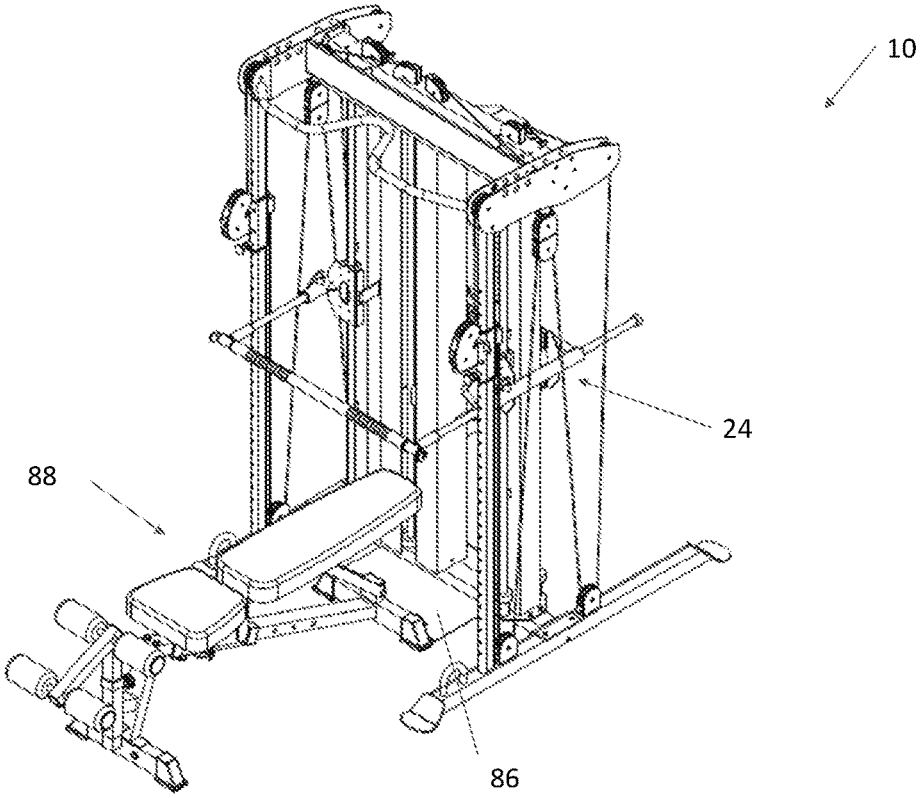
FIG. 10B is a front perspective view of the exercise machine of FIG. 10 illustrated with additional exercise equipment.

FIG. 10A and FIG. 10B are front perspective views illustrating a bracket 86. The bracket 86 may be configured to accept additional exercise equipment 88. The additional exercise equipment 88 may include, but is not limited to, a bench, box, rowing device, chain, or the like.

It is notable that the vertical travel of the cables described herein may be upward or downward, even when particularly described in one such direction. Likewise, the horizontal travel of the cables described herein may be from left to right or from right to left, even when particularly described in one such direction. Additionally, the vertical and horizontal travel of the cables described herein may be at an angle.

Figure 11:
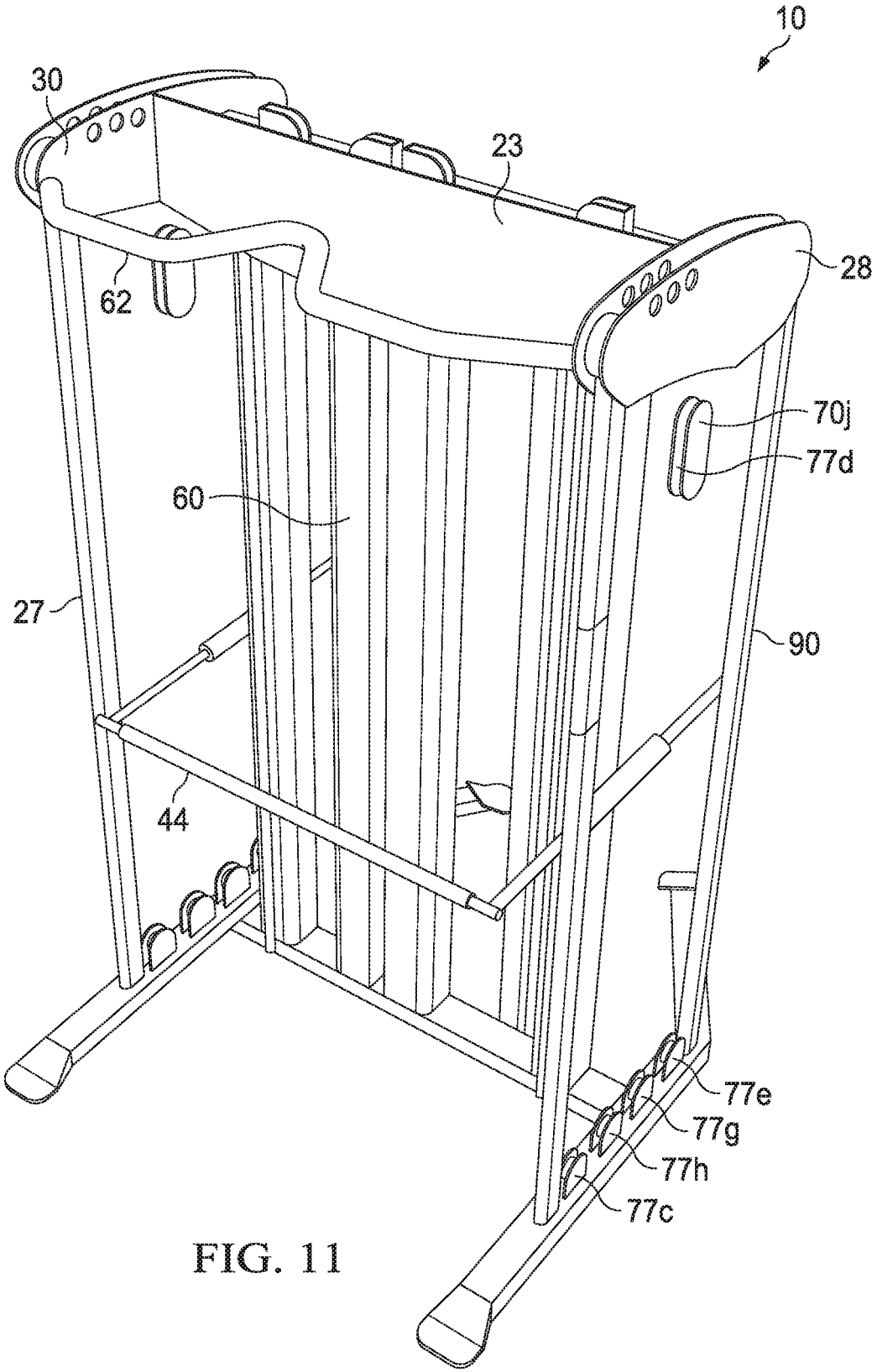
FIG. 11 is a front perspective view of another exemplary embodiment of the exercise machine.

FIG. 11 is a front perspective view of another exemplary embodiment of the exercise machine 10. The front bar 44 may comprise an anodized plating. In exemplary embodiments, the front bar 44 may be comprised of a metal, such as aluminum.

Figure 12:
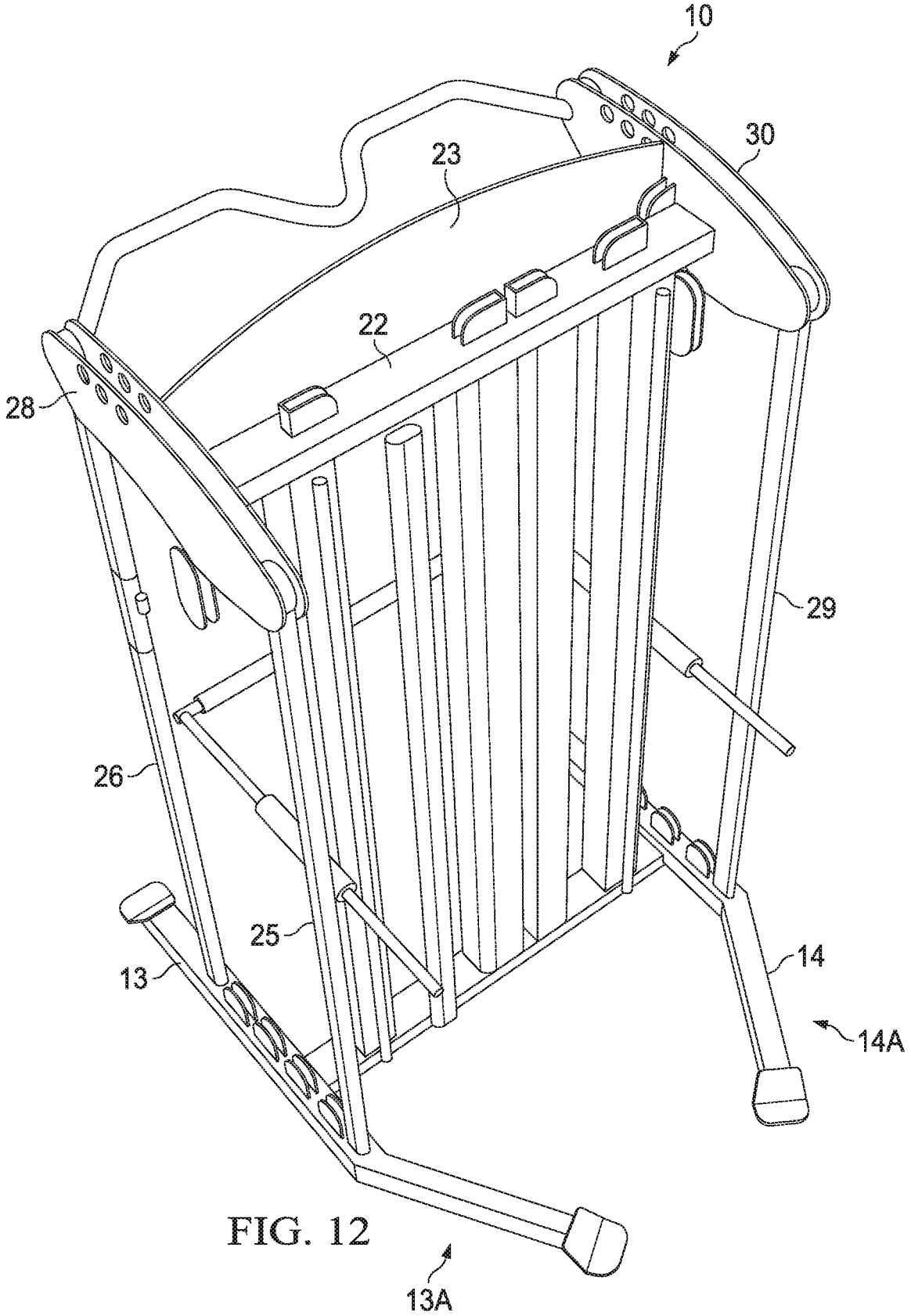
FIG. 12 is a rear perspective view of the exercise machine of FIG. 11.

FIG. 12 is a rear perspective view of the exercise machine 10 of FIG. 11. The exercise machine 10 may further comprise a fifth vertical member 25 and a sixth vertical member 29. The fifth vertical member 25 may extend from first base member 13 to the first upper bracket 28. The sixth vertical member 29 may extend from the second base member 14 to the second upper bracket 30.

In exemplary embodiments, the fifth and sixth vertical members 25 and 29 may be spaced apart and extend substantially parallel to one another. The fifth and sixth vertical members 25 and 29 may extend substantially perpendicularly from the first and second base member 13 and 14, respectively, though such is not required. In exemplary embodiments, the fifth and sixth vertical members 25 and 29 may be located behind the third and fourth base members 26 and 27, respectively. The fifth and sixth vertical members 25 and 29 may extend substantially parallel with the third and fourth base members 26 and 27, though such is not required.

The fifth and sixth vertical members 25 and 29 may be substantially oval in shape, though any shape is contemplated. One or more hooks 90 may be located along the third, fourth, fifth, and/or sixth vertical members 26, 27, 25, and 29. Indeed, any number of hooks 90 are contemplated at any number of locations on the exercise machine 10. The hooks 90 may be configured to hold various accessories for use with the exercise machine 10, such as but not limited to, weights, handles, gripping devices, and the like.

A distal portion 13A of the first base member 13 may extend inwardly. A distal portion 14A of the second base member 14, may also extend inwardly. In exemplary embodiments, the distal portions 13A and 14A of the first and second base members 13 and 14 may extend towards one another. This arrangement may increase the stability of the exercise machine 10.

An upper cover 23 may extend between the first and second upper brackets 28 and 30. In exemplary embodiments, the upper cover 23 may extend proximal relative to the upper member 22, but distal to the exercise bar 62. The upper cover 23 may be curved such that it is bowed towards the exercise bar 62, though such is not required. The first and second upper brackets 28 and 30 may be rounded to provide an aesthetically appeasing shape. The shroud 60 may comprise rounded corners.

Figure 13:
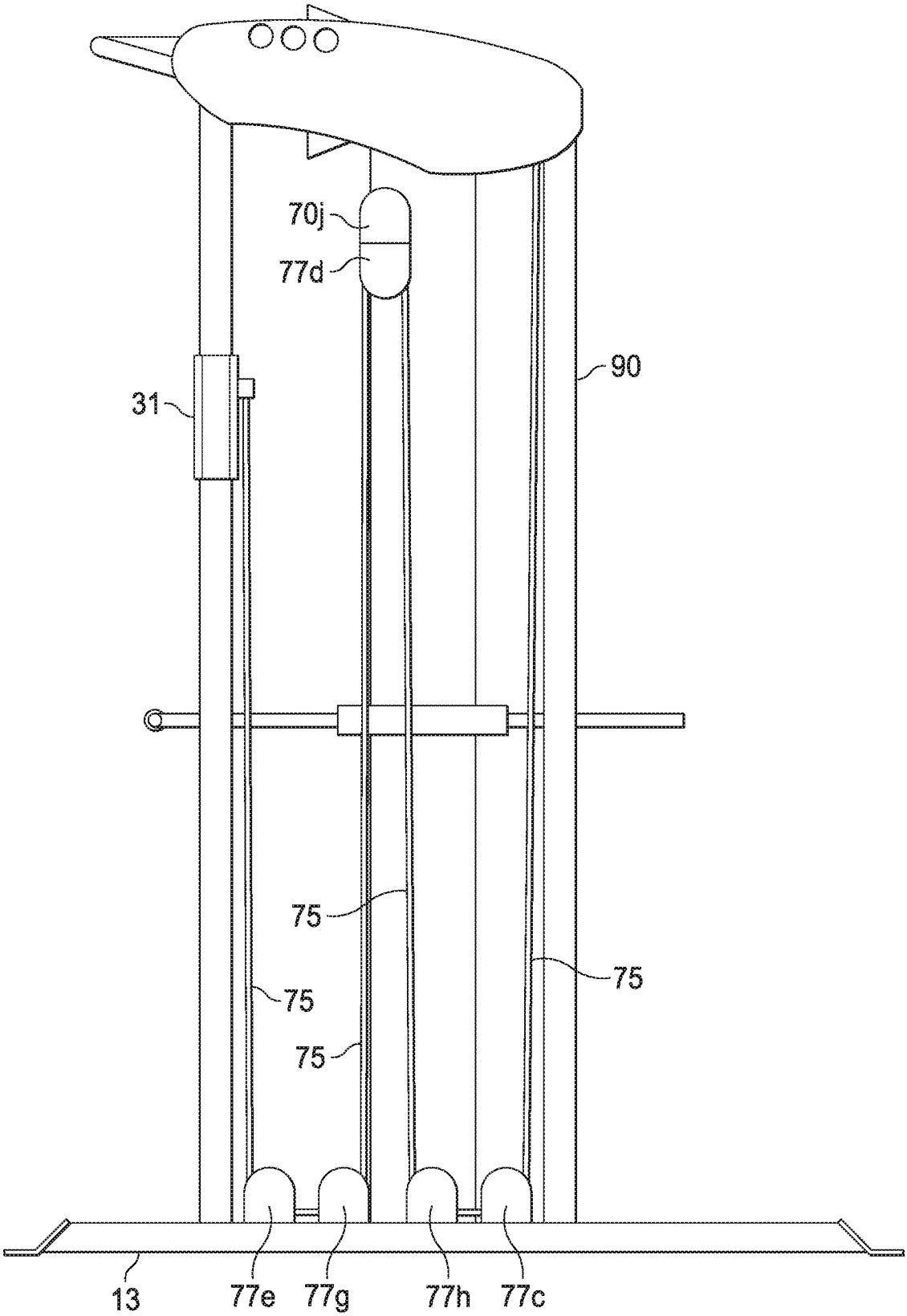
FIG. 13 is a right-side view of the exercise machine of FIG. 11.

FIG. 13 is a right-side view of the exercise machine of FIG. 11. A sixth functional device pulley 77*g* may be located between the fourth functional device pulley 77*d* and the fifth functional device pulley 77*e*. In exemplary embodiments, the sixth functional device pulley 77*g* may be located along the first base member 13. The sixth functional device pulley 77*g* may permit the third cable 75 to extend a distance horizontally along the third base member 13 before extending vertically. In this way, the third cable 75 may extend substantially parallel to the first base member 13 between the fifth functional device pulley 77*e* and the sixth functional device pulley 77*g*. The third cable 75 may then extend substantially perpendicular to the first base member 13 from the sixth functional device pulley 77*g* and the fourth functional device pulley 77*d*.

A seventh functional device pulley 77*h* may be located between the third functional device pulley 77*c* and the fourth functional device pulley 77*d*. In exemplary embodiments, the seventh functional device pulley 77*h* may be located along the first base member 13. The seventh functional device pulley 77*h* may permit the third cable 75 to extend a distance horizontally along the third base member 13 before extending vertically. In this way, the third cable 75 may extend substantially parallel to the first base member 13 between the third functional device pulley 77*c* and the seventh functional device pulley 77*h*. The third cable 75 may then extend substantially perpendicular to the first base member 13 from the seventh functional device pulley 77*h* and the fourth functional device pulley 77*d*.

The addition of the sixth and seventh functional device pulleys 77*g* and 77*h* may eliminate the need for the third cable 75 to extend at a non-perpendicular angle relative to the first base member 13. This may permit the third cable 75 to be better hidden, which may decrease the likelihood that a user would inadvertently contact the third cable 75. A similar or equivalent arrangement may be located on the opposite side of the exercise machine 10.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention.

Many of those variations and modifications will provide the same result and fall within the spirit of the claimed invention. It is the intention, therefore, to limit the invention only as indicated by the scope of the claims.

What is claimed is:

1. An exercise machine comprising:

a base;

a resistance device;

vertical members extending from said base;

a moveable section mounted to said vertical members and configured to move vertically along said vertical members and horizontally towards or away from longitudinal axes of the vertical members;

additional vertical members extending from said base, wherein said additional vertical members are located outside of said vertical members; and functional training devices, each mounted to one of said additional vertical members, configured to facilitate three-dimensional exercise movements, and comprising pulleys configured to accommodate a cable mechanically liked to said resistance device and extending along said pulleys to a cable termination device located at a distal portion of said cable.

2. The exercise machine of claim 1 wherein:

each of the cable termination devices comprises an attachment device configured to receive one of a number of handles.

3. The exercise machine of claim 2 wherein:

each of said attachment devices comprises a carabiner.

4. The exercise machine of claim 1 wherein:

each of said functional training devices is configured to be selectively secured at one of a number of vertical positions along an associated one of the additional vertical members; and each of said cable termination devices comprises a stopper.

5. The exercise machine of claim 1 wherein:

said moveable section comprises sliding devices configured to permit the vertical movement of the moveable section along the vertical members; and said moveable section comprises:

horizontal bars;

tubes configured to accept said horizontal bars and facilitate the horizontal movement of the moveable section; and a front bar extending between said horizontal bars.

6. The exercise machine of claim 1 further comprising:

attachment devices provided at said moveable section, wherein said attachment devices are configured for selective attachment to the cables of said functional training devices to increase a resistance experienced when moving the moveable section.

7. The exercise machine of claim 1 further comprising:

at least one additional cable mechanically linked to said resistance device and said moveable section; and a cable tensioning device configured to accommodate said at least one additional cable and maintain tension within said at least one additional cable in order to mechanically translate resistance from said resistance device to said moveable section upon vertical movement of said moveable section.

8. The exercise machine of claim 7 wherein:

said cable tensioning device comprises a number of pulleys mounted to a plate;

said plate is affixed to one of said vertical members; and said at least one additional cable is affixed to said plate and extends through each of said number of pulleys to said resistance device.

9. The exercise machine of claim 1 further comprising:

a bracket configured to mate with an additional exercise equipment item selected from the group consisting of: a bench and a rowing device.

10. The exercise machine of claim 1 wherein:

said resistance device comprises a weight stack; and the mechanical linkage between said cable and said resistance device is indirect.

11. The exercise machine of claim 1 further comprising:

one or more securing devices located at said moveable section and configured to temporarily secure the moveable section at one of a number of horizontal positions.

12. The exercise machine of claim 1 further comprising:

an upper member extending between said vertical members; and upper brackets located on opposing sides of said upper member and extending perpendicular to said upper member.

13. The exercise machine of claim 1 further comprising:

an exercise bar extending between said additional vertical members.

14. An exercise machine comprising:

a base;

a resistance device;

a first set of members extending upward from said base;

a moveable section mounted to said first set of members and configured to move up and down along said first set of members, wherein said moveable section is configured to permit movement of a front bar towards or away from longitudinal axes of said first set of members;

a second set of members extending upward from said base, wherein said second set of members are located outside said first set of members;

at least one stabilizing member extending laterally between at least one of said first set members and at least one of said second set of members; and functional training devices, each mounted to one of said second set of members and configured to facilitate three-dimensional exercise movements, wherein each of the functional training devices comprises a first and second pulley configured to accommodate a cable mechanically linked to said resistance device and extending between said first and second pulley to a cable termination device located at a distal portion of said cable and configured to prevent travel of the cable between the first and second pulleys, and wherein each of the functional training devices is configured for movement along an associated one of said second set of members such that each of the functional training devices may be secured at one of a number of vertical positions along the associated one of said second set of members.

15. The exercise machine of claim 14 further comprising:

a carabiner located at each of said cable termination devices and configured to receive one of a number of differently shaped handles for exercise movements.

16. The exercise machine of claim 14 further comprising:

at least one additional cable mechanically linked to said resistance device and said moveable section; and attachment devices provided at said moveable section and configured to selectively receive the cables of said functional training devices to increase a resistance experienced when moving the front bar.

17. The exercise machine of claim 14 further comprising:

an exercise bar comprising a non-linear shape and extending between at least two of said second set of members.

18. The exercise machine of claim 14 wherein:

a portion of said exercise machine is configured to selectively mate with an additional exercise equipment item selected from the group consisting of: a bench and a rowing device.

19. The exercise machine of claim 14 further comprising:

a cable tensioning device comprising a number of pulleys mounted to a plate affixed to one of said first set of members; and at least one additional cable mechanically linking said resistance device to said moveable section, where said at least one additional cable travels through said number of pulleys of said cable tensioning device.

20. An exercise machine comprising:

a base;

a weight stack;

a first set of vertical oriented members extending upward from said base;

a moveable section mounted to said first set of vertically oriented members and configured to move along said first set of vertically oriented members in a first planar direction and comprising a front bar configured to move in a second planar direction perpendicular to said first planar direction to facilitate performance of certain three-dimensional exercise movements;

a second set of vertically oriented members extending upward from said base;

functional training devices, each mounted to one of said second set of vertically oriented members and configured to facilitate performance of additional three-dimensional exercise movements and comprising pulleys configured to accommodate a cable mechanically linked to said weight stack and extending between said pulleys to a stopper device located at a distal portion of said cable which prevents travel through said pulleys, wherein each of said functional training devices is configured for sliding movement along said second set of vertically oriented members such that each of said functional training devices is securable at one of a number of vertical positions along said second set of vertically oriented members;

at least one additional cable mechanically linked to said weight stack and said movable section such that resistance is provided to movement of said front bar of said moveable section upon performance of said certain three-dimensional exercise movements; and attachment devices provided at the front bar of said moveable section, wherein said attachment devices are configured to selectively receive the cables of said functional training devices to increase the resistance experienced when moving the front bar during performance of said certain three-dimensional exercise movements.

* * * * *